US006813860B2

(12) United States Patent
Burnette et al.

(10) Patent No.: US 6,813,860 B2
(45) Date of Patent: Nov. 9, 2004

(54) CROSSING GATE REPAIR KIT AND METHOD

(76) Inventors: Wayne Board Burnette, 3103 Crab Orchard Rd., Huddleston, VA (US) 24104-9716; Charles Glenn Perkins, 1114 Stratford Dr., Bedford, VA (US) 24523

( * ) Notice: Subject to any disclaimer, the term of this patent is extended or adjusted under 35 U.S.C. 154(b) by 56 days.

(21) Appl. No.: 10/128,386

(22) Filed: Apr. 23, 2002

(65) Prior Publication Data

US 2002/0152683 A1 Oct. 24, 2002

Related U.S. Application Data

(60) Provisional application No. 60/285,623, filed on Apr. 23, 2001.

(51) Int. Cl.[7] ..... E01F 13/00; E01F 9/00; E05F 15/00

(52) U.S. Cl. ..... 49/49; 49/140; 246/125; 404/10

(58) Field of Search ..... 44/49, 140, 13, 44/381, 249, 9; 105/341; 256/1, 73, 59; 403/102; 404/6, 9, 10, 11; 52/18, 99; 246/127, 125, 261, 272

(56) References Cited

U.S. PATENT DOCUMENTS

| | | | | |
|---|---|---|---|---|
| 3,686,794 A | * | 8/1972 | Sakamoto et al. | 49/141 |
| 4,090,685 A | | 5/1978 | Pappas | |
| 4,219,969 A | * | 9/1980 | Reinitz et al. | 49/141 |
| 5,671,563 A | | 9/1997 | Marcum | |
| 5,852,350 A | | 12/1998 | LeVoir | |
| 5,884,432 A | * | 3/1999 | DeLillo | 49/49 |
| 5,992,800 A | * | 11/1999 | Sass | 246/127 |
| 6,470,626 B2 | * | 10/2002 | Luetzow et al. | 49/9 |

* cited by examiner

*Primary Examiner*—Hugh B. Thompson, II
(74) *Attorney, Agent, or Firm*—Donavon Lee Favre

(57) ABSTRACT

A railroad crossing gate is repaired by lowering the crossing gate mechanism with a lever. The end of the lever can contain a conical opening mating with the conical pivot pin on the gate mechanism.

14 Claims, 7 Drawing Sheets

CROSSING GATE REPAIR KIT AND METHOD

CROSS REFERENCE TO RELATED APPLICATIONS

This application discloses and claims subject matter disclosed in co-pending provisional patent application Ser. No. 60/285,623, filed Apr. 23, 2001. The priority of Ser. No. 60/285,623 is claimed for the present application.

BACKGROUND OF THE INVENTION

Controllable crossing gate arms have long been employed in various situations where a physical barrier is required to prevent traffic flow. These crossing gate arms are capable of pivoting upwardly out of the path of traffic in response to a command signal, thereby allowing the traffic to move freely when the barrier is not required. Typically, crossing gate arms are employed along roadways which cross railroad lines, as well as at highway toll booths and draw bridges in order to prevent passage of an automobile without payment of a desired toll or to allow a bridge to open.

Until the mid 1960's, crossing gate arms found at railway grade crossings were severely damaged or destroyed if struck by a highway vehicle when the crossing gate arm was in a road blocking horizontal attitude. Subsequently, a breakaway system was developed which protects crossing gates from collision damage. This breakaway system incorporates a pivot pin and shear pins which enable the gate arm to swing out of the way of traffic in response to a collision with an automobile and drop free of the crossing arm support structure to the ground in a disabled position displaced from and approximately parallel to the roadway.

The pivot pin of the crossing arm assembly is connected between a crossing gate arm and its support structure. The support structure pivots the gate arm through a vertical arc between a road blocking horizontal attitude and an open road vertical attitude. The pivot pin and gate arm cooperate so that the gate arm is free to pivot through a defined horizontal arc about the pivot pin from the road blocking horizontal attitude to a release position parallel to the roadway when an automobile strikes the gate arm. During normal operation, this horizontal pivoting motion is inhibited by the use of shear pins which are mounted through the crossing arm support structure and the gate arm adapter, such that the gate arm remains in a fixed position relative to the support structure while the shear pins arm in place. These pins retain the position of the gate arm until hey are manually removed during maintenance of the gate arm, or until they are sheared from the support structure by the force of an automobile striking the gate arm.

Once an automobile strikes the gate arm and the gate arm swings to the release position, the gate arm adapter is arranged so that the adapter and connected gate arm freely fall away from the pivot pin and drop to the ground in the disabled position. This breakaway function allows the gate arm to fall away from the roadway as well as the railroad tracks, thus ensuring that the gate arm will not be a further hazard to traffic, and will not be further damaged once it has detached from the support structure. The gate arm typically is damaged by the automobile impact that prompted the breakaway function so that repair usually is required of the gate arm.

The breakaway system on the older gate arms, however, does not provide a means for effective maintenance of the gate arm. In particular, when the prior art gate arm requires maintenance, a maintenance person is usually required to lower the gate arm to the road blocking horizontal attitude which is almost impossible for one man to do because the counterweight must be lifted.

The following are solutions which have been patented to help solve the problem:

U.S. Pat. No. 4,090,685 discloses using a ratchet wrench to turn the motor to raise the counterweight.

U.S. Pat. No. 5,671,563 discloses a one man replaceable gate.

U.S. Pat. No. 5,852,350 discloses using a motor to raise the counterweight.

The last two patents do not apply to repairing crossing gates that have been in place for years.

SUMMARY OF THE INVENTION

The present invention is directed to a lever arm which is used to replace the crossing gate arm and then used to raise the counterweight so that the crossing gate arm can be replaced.

DETAILED DESCRIPTION

Figure 1:
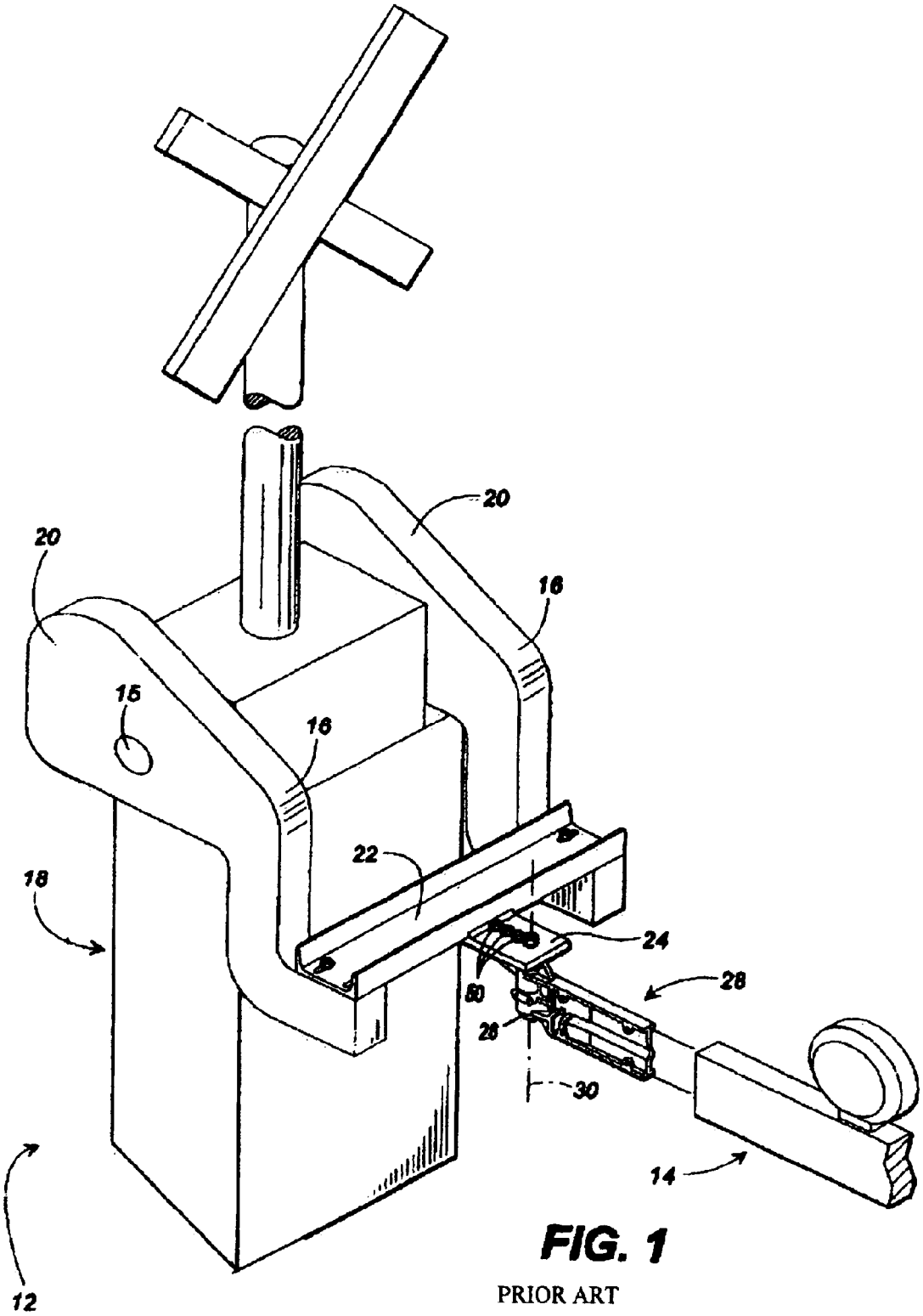
FIG. 1 PRIOR ART
FIGS. 1, 2 and 3 show a conventional crossing gate mechanism.
Figure 3:
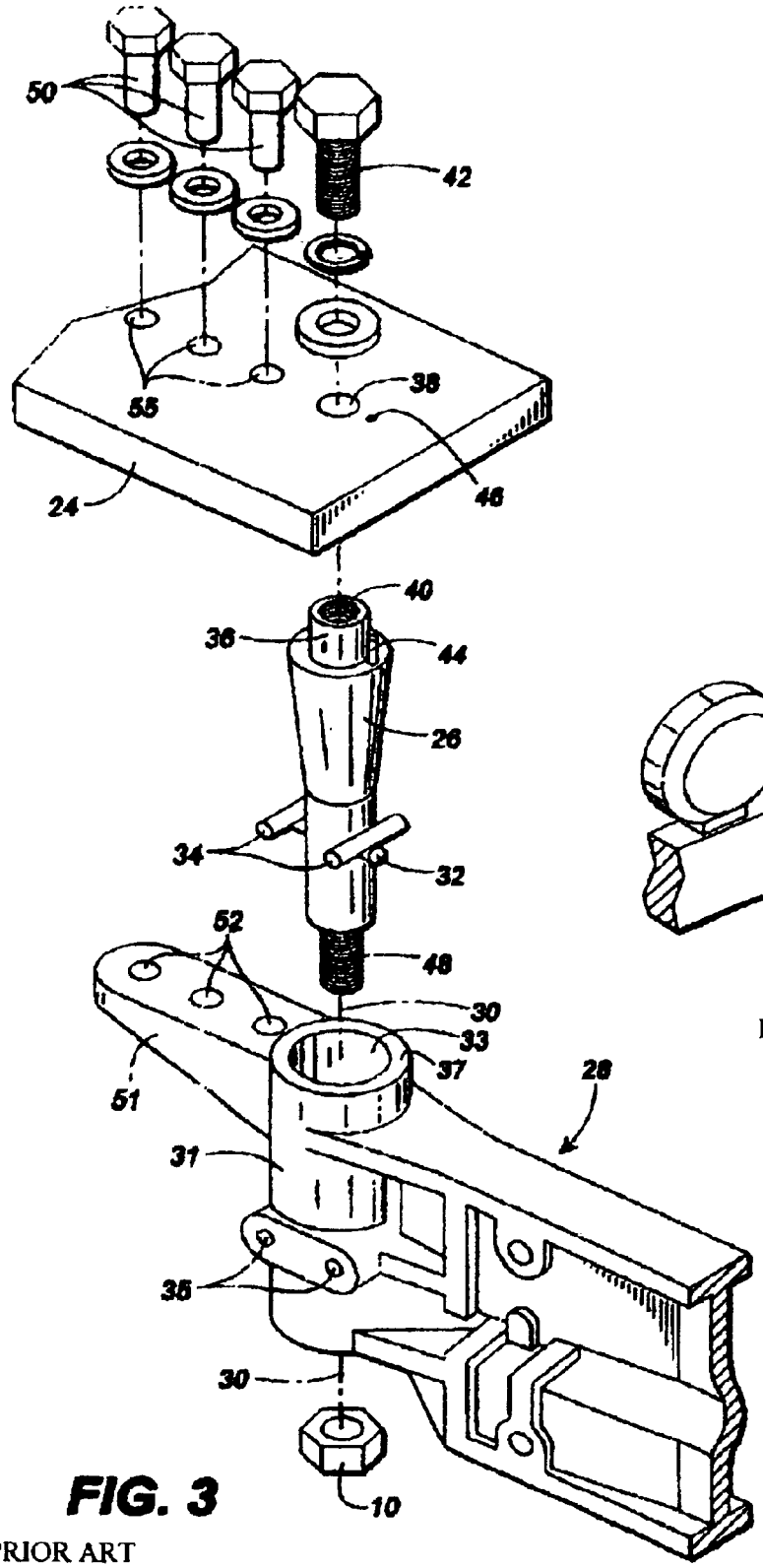
FIG. 3 PRIOR ART
Figure 2:
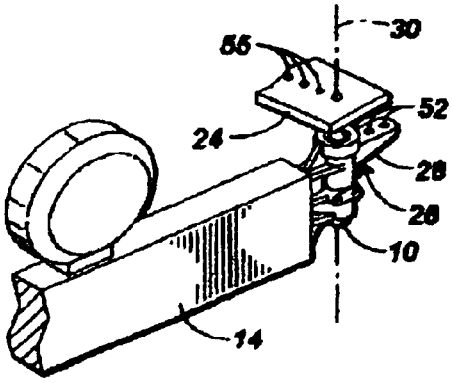
FIG. 2 PRIOR ART
Figure 4:
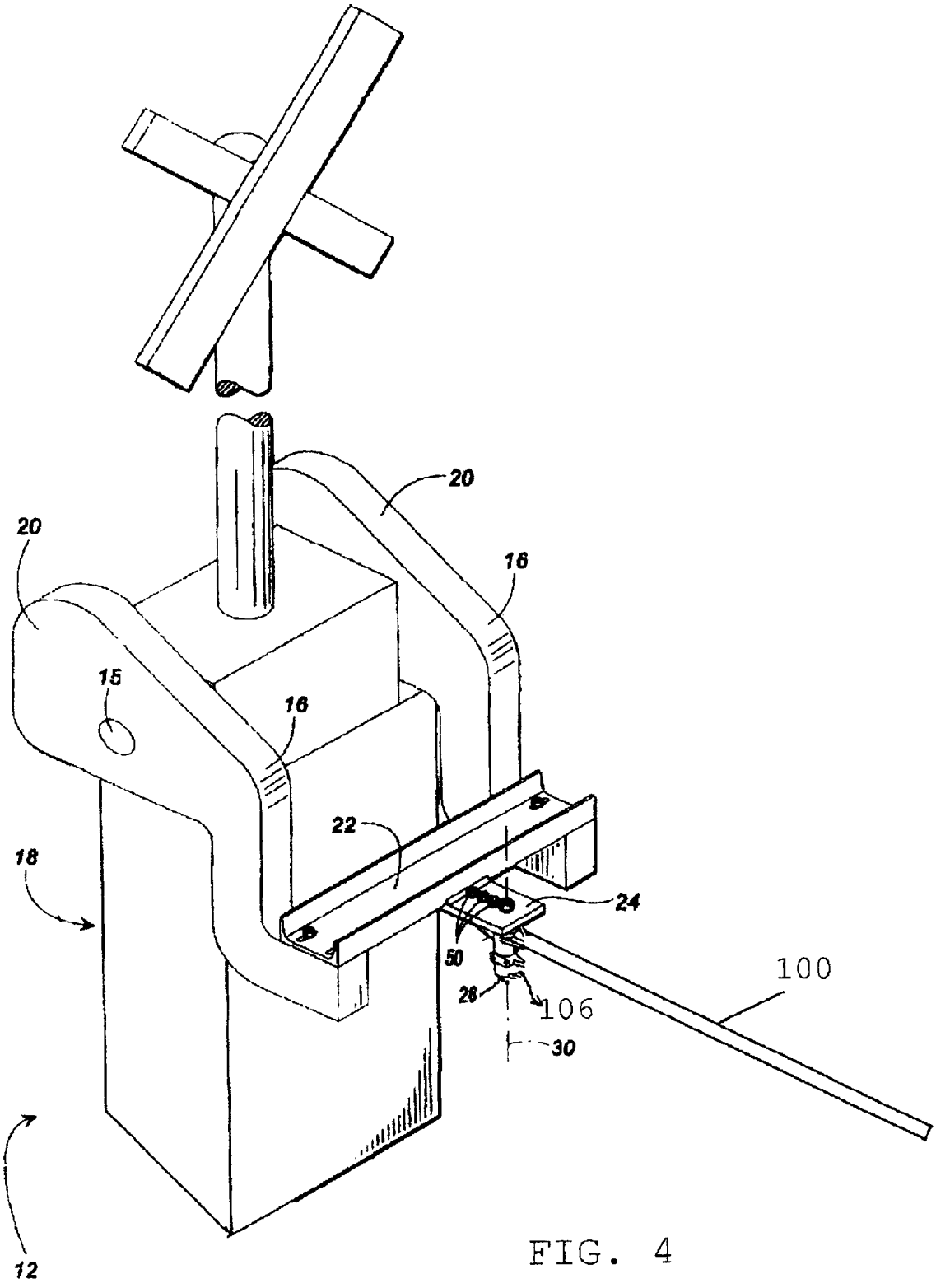
FIG. 4 shows the crossing gate replaced with a lever for the purposes of lowering the gate mechanism.
Figure 5:
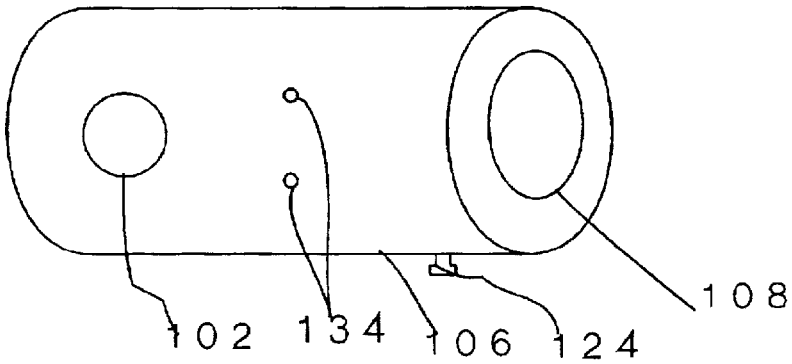
FIGS. 5 and 6 show a receptacle having a conical opening to mate with the conical pivot pin of the crossing gate mechanism.
Figure 6:
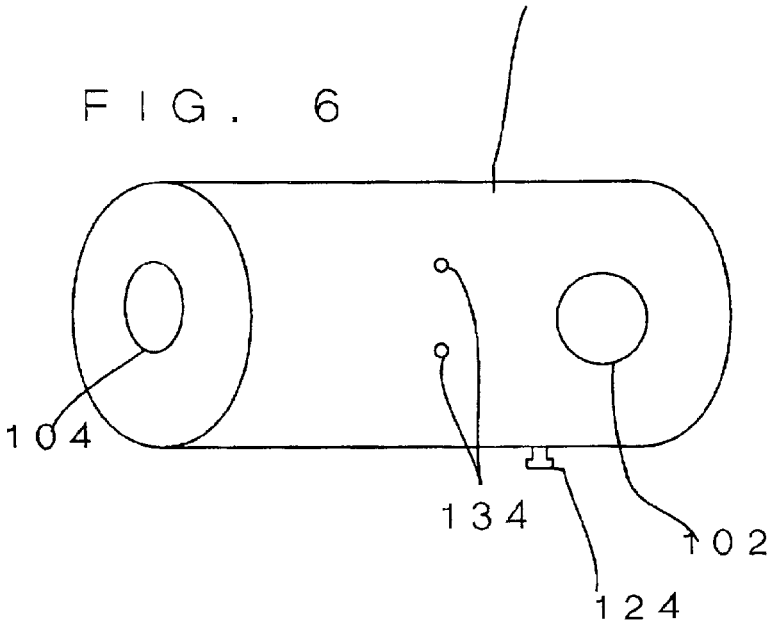

By simultaneously refining to FIGS. 1, 2 and 3, the construction and operation of a railroad crossing assembly can best be understood.

The railroad crossing gate assembly 12 commonly used incorporates a gate arm 14 and support arms 16. Support arms 16 pivot about shaft 15 and about control assembly 18 wherein a control mechanism is contained. Also, counterweights 20 are mounted at the end of each support arm 16 to balance the weight of gate arm 14. Support arms 16 are joined by horizontal coupling plate 22. Coupling plate 22 incorporates extension plate 24 which is attached to pivot pin assembly 26. Pivot pin assembly 26 also pivotally engages adapter 28. When the control mechanism receives a first command signal, the control mechanism pivots gate arm 14 about pivot shaft 15 upwardly through a vertical arc, raising it from a road blocking horizontal attitude, shown in FIG. 1, to an open road vertical attitude such that the gate arm is substantially vertical to the ground The use of counterweight means 20 at the end of support arms 16 assist in counterbalancing the weight of gate arm 14 thereby reducing the rotational force needed for the pivoting action. When a second command signal is received by the control mechanism, gate arm 14 is pivoted downwardly through the vertical arc, lowering it from the open road vertical attitude to the road blocking horizontal attitude shown in FIG. 1, effectively blocking the roadway.

Pivot pin 26 has a longitudinal pivot axis 30 and is mounted to extension plate 24 and incorporates a support means for adapter 28. As shown in FIG. 3, the preferred embodiment of the support means is cross pin 32. Cross pin 32 extends through and is supported by stationary pivot pin 26, with its ends protruding at opposite sides from the pivot pin. Support pins 34 mounted on adapter 28 extending as chords through the vertical cylindrical opening 33, telescopically inserted through side openings 35, and supported at their ends in the sidewall 37 of the adapter sleeve 31. The support pins 34 rest on the ends of the cross pin 32. Thus, the adapter and gate arm are retained by pivot pin 26 while in all positions, except a release position, shown in FIG. 2. When the gate arm has pivoted toward the release position, pins 34 rotate toward a position parallel to the cross pin 32 and lose supporting engagement with the cross pin 32. Therefore, the pins 32 and 34 function as releasable support means for disengaging the adapter 28 and gate arm 14 from the pivot pin 26 and allow the adapter and the gate arm to fall away from the pivot pin 26 to a disabled position on the ground.

Pivot pin 26 is mounted to extension plate 24 by incorporating a first or upper end portion 36 mounted through hole 38 of the extension plate. First end portion 36 contains a threaded bore 40 which threadedly engages bolt 42 to securely mount pivot pin 26 to extension plate 24. Pivot pin 26 additionally incorporates locating pin 44 which extends into locator hole 46 in extension plate 24 so that pivot pin 26 and support means 32 are properly oriented.

Shear pin arm 51 extends laterally from sidewall 37 of adapter sleeve 31, and shear pins 50 normally are extended through aligned openings 52 and 55 of extension plate 24 and shear pin arm 51.

Once an automobile strikes the gate arm 14 and the gate arm 14 swings to the release position, the gate arm adapter 28 is arranged so that the adapter 28 and connected gate arm 14 freely fall away from the pivot pin 26 and drop to the ground in the disabled position because cross pin 32 no longer supports support pins 34. This breakaway function allows the gate arm 14 to fall away from the roadway as well as the railroad tracks, if all goes well, thus ensuring that the gate arm 14 will not be a further hazard to traffic, and will not be further damaged once it has detached from the support structure. The gate arm typically is damaged by the automobile impact that prompted the breakaway function so that repair usually is required of the gate arm 14.

In order to reattach repaired gate arm 14, it is necessary to lift counterweights 20. Counterweights 20 weigh several hundred pounds and to raise them so that gate arm 14 can be attached in a horizontal position is extremely difficult for two strong men and virtually impossible for one man. In addition there is serious risk of bodily injury from the strain of lifting and the danger that the counterweights will fall and hit the person or persons trying to lift them.

By one embodiment of the present invention, as shown in FIGS. 4 through 9, the counterweights 20 are lifted using a lever 100. The lever 100 can be integral with cylinder 106 or can be inserted into lever openings 102 or 104 of a cylinder 106. Cylinder 106 has a pivot pin opening 108 designed to accommodate pivot pin 26 and support pins 134 corresponding to support pins 34 in adapter 28.

To attach the cylinder 106 to the pivot pin 26, opening 102 is aligned parallel to the highway so that support pins 134 will slide up between cross pin 32. The cylinder 106 is then turned perpendicular to the highway to hold the cylinder 106 in place by support pins 134 moving above cross pin 32. Lever 100 is then inserted into lever opening 102 or 104 and the lever is used to rotate counterweights 20 to a raised or gate closed position. Repaired gate arm 14 is then reattached to adapter 28. This can be done with the gate arm 16 parallel to the railroad track, but is preferably done with gate arm 16 out of the highway.

Figure 9:
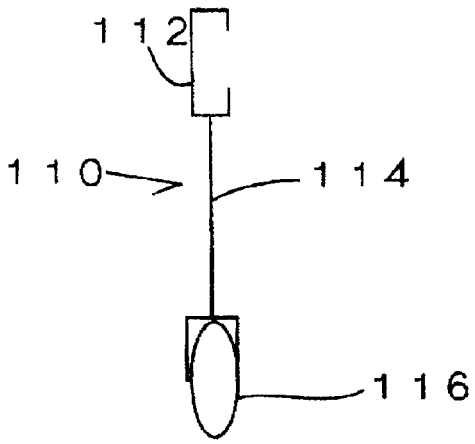
FIG. 9 shows a support mechanism used to support the gate during repair.

During attachment, the end of gate arm 16 opposed to adapter 28 is held up by a support 110 (see FIG. 9). The support 110 in one embodiment is a bracket 112 to hold die end of gate arm 14. A rod 114 is positioned between the bracket 112 and a ground-engaging wheel 116. The support can also be a tripod, not shown.

A power down switch 118 (see FIG. 8) can be used to make contact in the control assembly 18 to make contact to keep the gate arm 14 in the down position. Power down switch 118 includes two conductors 120 and 122 having alligator clips 128 and 130 at their terminals to connect to contacts in the control assembly 18.

A hold down clamp, not shown, can also be used to hold adapter 28 is the down position to aid in the attachment or the repaired gate arm 14 to adapter 28.

A set-screw 124 (see FIGS. 5 and 6) can be positioned in the side of cylinder 106 to hold the pivot pin in place when opening 102 or gate arm 14 is parallel to the highway.

Figure 7:
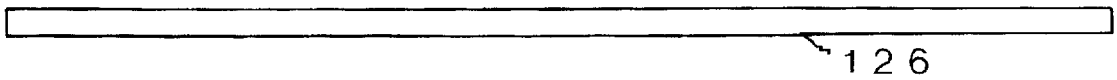
FIG. 7 shows a telescoping rod which is inserted into an opening of receptacle 5 to act as a lever.
Figure 8:
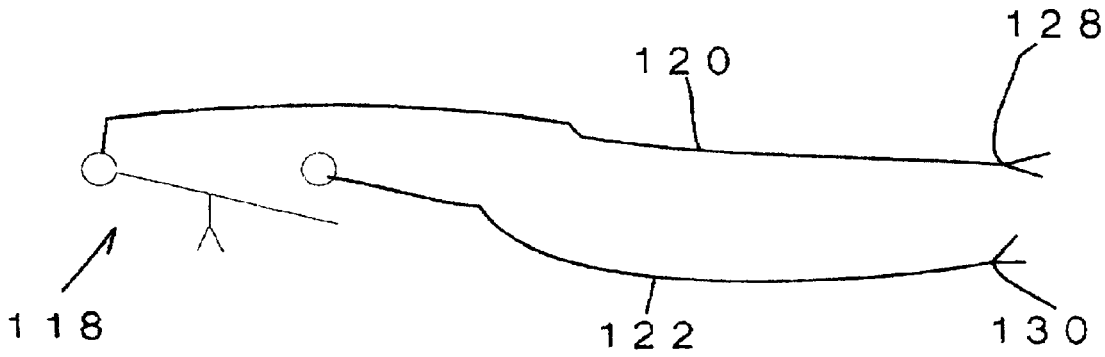
FIG. 8 shows a power down switch which is used to hold the gate mechanism in a lowered configuration for repair.

Lever 100 can also be a telescoping rod shown as 126 in FIG. 7.

A lever, not shown, can also be bolted to the adapter 28 and used to raise the counterweights 30, in lieu of lever 100.

Figure 10:
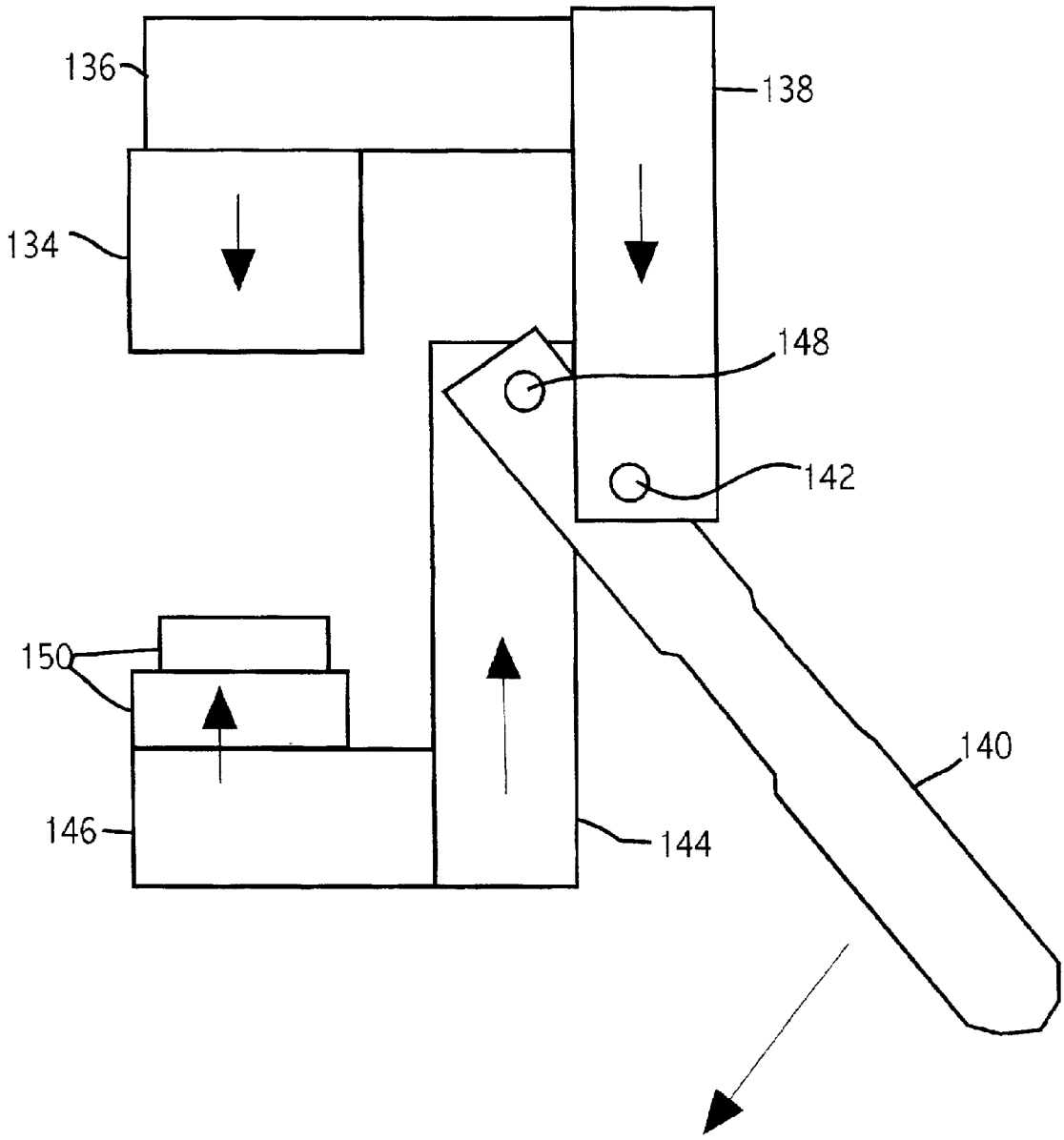
FIG. 10 is a side view of a clamp used to insert the conical pivot pin into a conical receptacle.
Figure 11:
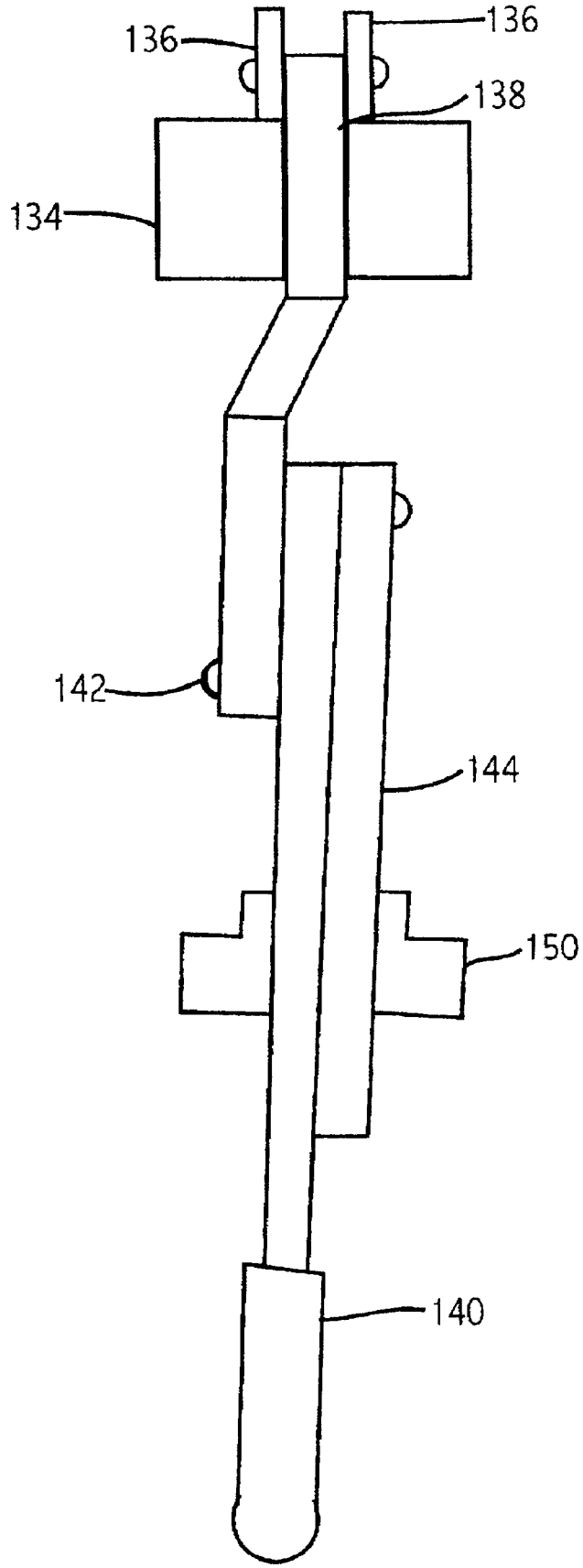
FIG. 11 is a top view of the clamp of FIG. 10.

A raising tool 132, shown in FIGS. 10 and 11 was designed to assist in the re-attachment of crossing gate arm 14 to adapter 28. Tool support 134 which can have the shape of an inverted cup, is placed over the head of bolt 42. Support 134 is mounted in fixed relationship to brackets 136 and 138 which are in right angle relationship. Lever arm 140 is attached to bracket 138 by a pivot pin 142. A second set of right angle brackets 144 and 146 are attached to lever arm 140 by pivot pin 148. Adapter support 150 is placed under adapter 28 which is attached to gate arm 14. Handle 140 is then pushed down, raising adapter 28 by way of adapter support 150 onto pivot pin 26. The gate 14 is then turned slightly to lock pin 32 below pins 34. With the gate 14 in place, it can be turned to the road blocking position and shear pins 50 can be put in place. The gate assembly 12 is again ready for use.

We claim:

1. In a an apparatus for repairing a crossing gate assembly, the crossing gate assembly comprising:

a) a support mechanism for mounting adjacent the intersection of a roadway and a railroad track;

b) a pivot arm support assembly pivotally connected to said support mechanism;

c) a conical pivot pin mounted to said pivot arm support assembly;

d) an adapter having a conical opening mounted to said pivot pin through the conical opening;

e) a gate arm mounted to said adapter;

wherein the improvement comprises:

f) a receptacle, other than the adapter, having a conical opening adapted to receive the pivot pin of a crossing gate, g) a lever, other than the gate arm, attached to the receptacle to allow one man to lower the crossing gate assembly pivot arm support assembly for the attachment of a crossing gate thereto.

2. The apparatus of claim 1 wherein the receptacle has an opening for the insertion of the lever.

3. The apparatus of claim 1 wherein the lever is a telescoping rod.

4. The apparatus of claim 1 wherein the receptacle is a cylinder.

5. The apparatus of claim 1 further including with a power down switch to keep the gate arm in a down position.

6. The apparatus of claim 1 further including with a clamp to assist in attaching the pivot pin to a receptacle having a conical opening.

7. The apparatus of claim 6 wherein the conical opening is a receptacle attached to the lever arm.

8. The apparatus of claim 6 wherein the conical opening is in a receptacle attached to a crossing gate.

9. The apparatus of claim 1 further including with a supporting mechanism for an intermediate portion of the crossing gate assembly.

10. The apparatus of claim 9 wherein a wheel is positioned on the bottom of the supporting mechanism.

11. A method of repairing a crossing gate assembly, the crossing gate assembly comprising:

a) a support mechanism for mounting adjacent the intersection of a roadway and a railroad track;

b) a pivot arm support assembly pivotally connected to said support mechanism;

c) a conical pivot pin mounted to said pivot arm support assembly;

d) an adapter, having a conical opening mounted to said pivot pin through the conical opening;

e) a gate arm mounted to said adapter;

the method steps including:

a) attaching a lever to a crossing gate mechanism and lowering the mechanism to a gate down position, b) removing the lever from the crossing gate mechanism so as to attach a crossing gate arm to the lowered crossing gate mechanism.

12. The method of claim 11 further including the steps of with supporting the gate with a wheeled supporting mechanism for the gate to allow the gate to move in a swinging direction.

13. The method of claim 11 further including the steps of with clamping a pivot pin on the gate mechanism into a receptacle on an end of the gate.

14. The method of claim 11 further including the steps of with holding the gate mechanism in a lowered configuration while the gate assembly is being repaired.

* * * * *